United States Patent [19]

Hsu et al.

[11] Patent Number: 4,810,462

[45] Date of Patent: Mar. 7, 1989

[54] METHOD FOR FABRICATING PRESCRIBED FLAWS IN THE INTERIOR OF METALS

[75] Inventors: David K. Hsu; Donald O. Thompson, both of Ames, Iowa

[73] Assignee: Iowa State University Research Foundation, Inc., Ames, Iowa

[21] Appl. No.: 156,794

[22] Filed: Feb. 17, 1988

[51] Int. Cl.[4] ..... G22F 7/00

[52] U.S. Cl. ..... 419/8; 419/38; 419/54; 419/55; 164/80

[58] Field of Search ..... 419/8, 38, 54, 55; 164/80

[56] References Cited

U.S. PATENT DOCUMENTS

| | | | |
|---|---|---|---|
| 3,996,048 | 12/1976 | Fiedler | 419/8 |
| 4,203,315 | 5/1980 | View et al. | 73/1 R |
| 4,350,528 | 9/1982 | Engle | 419/8 |

*Primary Examiner*—Stephen J. Lechert, Jr.
*Attorney, Agent, or Firm*—Zarley McKee, Thomte, Voorhees & Sease

[57] ABSTRACT

The method for fabricating a metal body having a flaw of predetermined size and shape located therein comprises placing half of the metal powder required to make the metal body in the die of a press and pressing it to create a flat upper surface thereon. A piece of copper foil is cut to the size and shape of the desired interior crack and placed on the upper surface of the powder and centered in position. The remaining powder is then placed in the die to cover the copper foil. The powder is first cold pressed and removed from the press. The powder metal piece is then sintered in a furnace at a temperature above the melting point of the copper and below the melting point of the metal. It is then removed from the furnace, cooled to room temperature, and placed back in the die and pressed further. This procedure results in an interior flaw or crack. Modified forms of the method involve using a press-sinter-press-sinter cycle with the first sinter being below the melting point of the copper and the second sinter being above the melting point of the copper and below the melting point of the metal.

12 Claims, 1 Drawing Sheet

METHOD FOR FABRICATING PRESCRIBED FLAWS IN THE INTERIOR OF METALS

BACKGROUND OF THE INVENTION

This invention relates to a method for fabricating prescribed or predetermined flaws in the interior of metal body members.

Ultrasonic waves are presently used to analyze metal objects to determine whether or not they have internal flaws such as cracks or irregularly shaped voids. However, in making these evaluations, it is important to know the characteristics of these various shapes and sizes of flaws. In order to develop standards by which to evaluate the flaws found in unknown metal objects, it is necessary to manufacture or fabricate metal objects having flaws therein of predetermined known shape and configuration. These samples can be used as a standard to evaluate the ultrasonic results obtained from unknown metal bodies, and thereby can be helpful in evaluating the flaws which may appear as a result of ultrasonic evaluation.

These types of samples are used by researchers in testing their theory and modeling results and in calibrating their flaw detection instruments.

However, the production of models presents a difficulty in that the flaws within the models must have known size, shape and orientation. Since they are located internally of the metal body, it is difficult to fabricate them. The ability to fabricate prescribed flaws in the interior of metals has wide application in nondestructive evaluation research and methodology.

Therefore, a primary object of the present invention is the provision of a method for fabricating prescribed or predetermined flaws in the interior of metal body members.

A further object of the present invention is the provision of a method for fabricating these prescribed flaws with precision so that the exact size, shape and orientation of the flaw is known with certainty.

A further object of the present invention is the provision of a method which is simple, economical, and easy to practice.

SUMMARY OF THE INVENTION

The present invention involves the use of powder metallurgy techniques to produce a crack in the middle of an iron body member. The term "crack" as used herein refers to a thin flat hole or opening within the interior of the metal body. To produce a crack in the middle of an iron body member, half of the iron powder required to make the body member is first placed in the die of a press and pressed flat. A piece of copper foil is cut to the size and shape of the desired interior crack and is placed on the upper surface of the powder in centered position. The remaining powder is then placed in the die to cover the copper foil. The powder is first cold pressed to approximately 40 Tsi (tons per square inch) and removed from the press. The pressure applied during the initial pressure step can vary from the preferred pressure of 40 Tsi. It should be sufficient pressure to cause the powdered iron to hold its shape for handling. The pressure should not be so great as to cause the powdered iron to make indentation on perforations in the copper foil.

The powder metal piece is then sintered in a furnace at a temperature which exceeds the melting point of copper and is less than the melting point of iron for approximately 30 minutes. After sintering, the metal piece is removed from the furnace and cooled to room temperature. The preferred sintering temperature is 2050° F. The copper melts during the sintering process and is drawn into the porous metal which surrounds the copper so as to leave a crack in the place where the copper foil was originally placed.

After the sintered piece is cooled, it is preferably pressed a second time at a preferred pressure of approximately 50 Tsi. The purpose of the second pressure step is to compress or minimize the voids in the sintered metal. Application of greater pressure causes smaller pores or voids in the sintered metal. The pressure applied during the second pressure step can vary from no pressure at all (eliminating the second pressure step altogether) to a pressure which is higher than 50 Tsi, but which will not cause a collapse of the crack left in the place of the copper foil.

The above process results in the formation of a crack which has substantially then same shape and size of the copper foil as measured in the plane of the copper foil. The thickness of the crack may vary slightly, depending on the pressure applied during the second pressure step of the above process.

Using the same techniques, samples have also been made to contain volumetric voids by embedding regularly- and irregularly-shaped copper pieces (example, a sphere or ellipsoid).

A modified form of the process involves using a press-sinter-press-sinter cycle with the first sinter cycle being below the melting point of copper, and the second sinter cycle being above the melting point of copper and below the melting point of the iron. The finished powder metal samples produced by the above methods have a density approximately equal to 95 percent of iron and contain approximately 5 percent porosity by volume. This is true for both the three-step process and the four-step process. However, the four-step process produces cracks of a greater thickness.

Such porosity may be reduced or eliminated by using a forging process or by using a hot isostatic pressing process. The forging process utilizes heat in close proximity to the iron melting point while at the same time applying pressure which is unidirectional. The isostatic press involves the use of a gas medium which is placed under pressure and which is used to transfer this pressure evenly to the powdered metal. Forging and hot-isostatic pressing are expensive and are needed only if the small amount of porosity must be eliminated.

DETAILED DESCRIPTION OF THE PREFERRED EMBODIMENT

Figure 1:
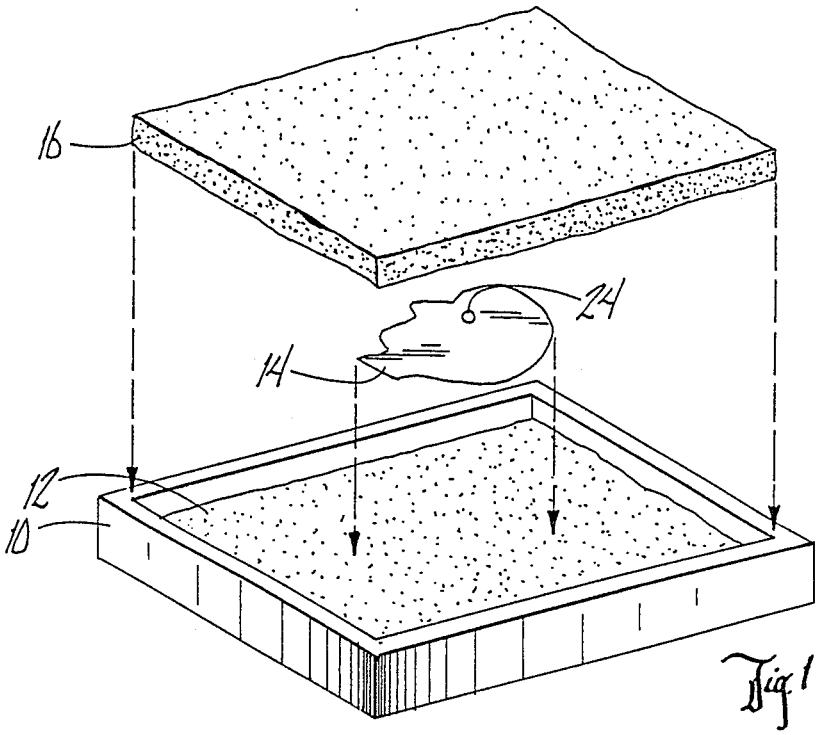
FIG. 1 is an exploded perspective view of the components used in the process of the present invention.
Figure 2:
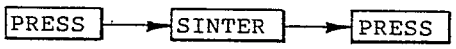
FIG. 2 is a block diagram showing the steps of the process.

Referring to the drawings, the numeral 10 generally refers to a die which is utilized with the present invention. Within die 10 is a layer of powdered metal 12. Powdered metal 12 may be iron capable of being sintered or heat- and pressure-molded into a solid metal body member. A copper foil piece 14 is shown in FIG. 1 to be in the shape of a human head profile. The particular shape of foil 14 is meant to be illustrative and can take any desired shape or form needed or desired for the ultimate flaw in the body member. The ultimate flaw which is produced by the present method is of the same shape and size as the cutout figure used for the copper foil 14.

The copper foil 14 is placed on the upper surface of the first layer 12 and then is covered by a second layer of powdered metal 16. After layer 16 has been placed over foil 14, a press (not shown) is used to apply pressure to the layers 12, 14, and 16.

The pressure applied should be approximately 40 Tsi so as to cause the powdered metal to form into a powdered metal piece.

Figure 3:
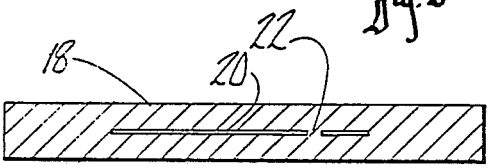
FIG. 3 is a sectional view of the metal body produced by the method of the present invention.

The powdered metal piece is then removed from the press and placed in a furnace where it is sintered at a temperature of approximately 2050° F. for 30 minutes. The temperature chosen for the sintering process should be above the melting point of the copper while at the same time being below the melting point of the iron. The sintered piece is then removed from the furnace and cooled to room temperature. FIG. 3 shows a cross-sectional view of the metal body 18 after sintering and pressing has been completed. Body 18 includes a crack or void 20 which has been formed in the place where the copper foil piece 14 had been placed prior to sintering.

Figure 4:
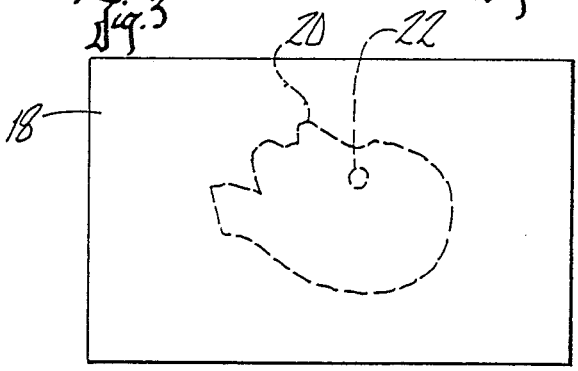
FIG. 4 is a top plan view of the metal body member shown in FIG. 3.

It has been found that by utilization of the present method, it is possible to make a crack which has a surface separation of from 1 to 3 micrometers. The crack is produced by utilizing a piece of copper foil having a thickness of approximately 0.005 inches. Subsequent metalographic examination of sections cut perpendicularly through the void 20 have revealed that there is no bridging (asperities) between the upper and lower surfaces of void 20. The size and shape of the void 20, as measured in the plane of copper foil, has been found to conform exactly to the original size and shape of the foil 14, as can be seen in FIG. 4. The thickness of the crack will vary slightly, depending on the amount of pressure applied during the second pressure step. The only bridging which appears in void 20 is at the location 22, and this is caused by the hole 24 in the metal foil 14.

Using the same techniques, samples have also been made to contain volumetric voids of various geometric shapes by embedding copper pieces conforming to these irregular shapes. For example, ellipsoidal shapes, spherical shapes or other irregular shapes can be formed by utilizing copper formed into these shapes in the place of the copper foil 14, although it has not been demonstrated that the shape and size of the void conforms exactly to the copper "seed."

Figure 5:
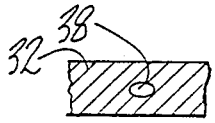
FIG. 5 is a sectional view showing a sample of a volumetric void produced by the present invention.

Referring to FIG. 5, body 32 includes a volumetric void 38 formed by utilizing a copper piece in the shape of an ellipsoid. The copper has been melted during the sintering process and has been drawn into the porous metal surrounding the void 38.

Figure 6:
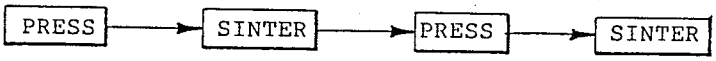
FIG. 6 is a block diagram showing a modified form of the process of the present invention.

FIG. 6 shows a modified form of the present process which can be particularly useful in providing voids of complex shape such as a bifurcated Y-shaped void. Bifurcated cracks may be produced with either the three-step or the four-step process. The four-step process seemed to result in cracks that are much "thicker" than the three-step process. This four-step process begins with an initial pressing step similar to the pressing step of the method described above. However, it is followed by a sintering step which is done at a temperature which is below the melting point of the copper foil or copper body member. Preferred temperature for this step of the process is approximately 1600° F. The body is then removed and pressed again. After the second pressing, it is sintered again at a higher temperature which is above the melting point of the copper and which is below the melting point of the iron. The preferred temperature for this second sintering step is approximately 2050° F.

Samples containing interior cracks or voids fabricated with the present invention have been proven very useful in non-destructive evaluation research. These samples can be used for a number of non-destructive evaluation techniques including the use of ultrasonics, eddy current technology, magnetic methods of evaluation, and radiography. The samples provided by the present invention have interior voids or cracks of predetermined size, shape and orientation within the metal, and this is particularly useful in evaluating other unknown body members. The versatility of the technique allows the fabrication of a great variety of interior flaws called for by particular non-destructive evaluation research or application purposes. The method is very inexpensive, and therefore, it can be utilized often. Thus, it can be seen that the device accomplishes at least all of its stated objectives.

We claim:

1. A method for fabricating a metal body having a flaw of predetermined size and shape located therein, said method comprising:

placing a portion of the total amount of metal powder required to make said metal body in a die of a press, said die having a configuration conforming to the desired shape of said metal body;

using said press to press said portion of said metal powder so as to create a flat planar upper surface on said portion of said metal powder;

placing a piece of copper foil on said upper surface of said portion of said metal powder; said piece of copper foil having a size and shape corresponding to the size and shape of said flaw;

placing the remainder of said total amount of metal powder in said die to cover said copper foil;

compressing said powder with said press;

removing said compressed powder with said copper foil therein from said press and placing said compressed powder in a sintering furnace;

sintering said compressed powder in said sintering furnace so as to cause said powder to form said metal body and so as to cause said copper foil to be melted and drawn into the porous metal of said metal body, thereby leaving a crack in the place where said copper foil was located before sintering.

2. A method according to claim 1 and further comprising placing said metal body in said press a second time after said sintering and compressing said sintered metal body so as to cause the thickness of said crack to be reduced.

3. A method according to claim 2 wherein said first mentioned compressing of said powder is done at approximately 40 tons per square inch.

4. A method according to claim 3 wherein said second compressing of said metal body is done at approximately 50 tons per square inch.

5. A method according to claim 1 wherein said sintering is done at a temperature above the melting point of said copper and below the melting point of said metal.

6. A method according to claim 5 comprising using iron powder as said metal powder.

7. A method according to claim 6 comprising sintering said metal powder at approximately 2050° F. for 30 minutes.

8. A method for fabricating a metal body having a flaw of predetermined size and shape located therein, said method comprising:

placing a portion of the total amount of metal powder required to make said metal body in a die of a press, said die having a configuration conforming to the desired shape of said metal body;

using said press to press said portion of said metal powder so as to create a flat planar upper surface on said portion of said metal powder;

placing foreign body of predetermined shape and size on said upper surface of said portion of said metal powder, said foreign body having a size and shape approximately corresponding to the size and shape of said flaw;

placing the remainder of said total amount of metal powder in said die to cover said foreign body;

compressing said powder with said press;

removing said compressed powder with said foreign body therein from said press and placing said compressed powder in a sintering furnace;

sintering said compressed powder in said sintering furnace so as to cause said metal powder to form into a solid metal body having a flaw formed therein which has the approximate size and shape of said foreign body.

9. A method according to claim 8 comprising using iron powder for said metal powder and utilizing copper for said foreign body.

10. A method according to claim 9 comprising sintering said compressed powder at a temperature less than the melting point of said iron and greater than the melting point of said copper whereby at least a portion of said copper will melt and be drawn into the porous metal surrounding said copper body, thereby producing a crack in said metal body having a shape and size conforming approximately to the size and shape of said foreign body.

11. A method for fabricating a metal body having a flaw of predetermined size and shape located therein, said method comprising:

placing a portion of the total amount of metal powder required to make said metal body in a die of a press, said die having a configuration conforming to the desired shape of said metal body;

using said press to press said portion of said metal powder so as to create a flat planar upper surface on said portion of said metal powder;

placing a piece of copper foil on said upper surface of said portion of said metal powder; said piece of copper foil having a size and shape corresponding to the size and shape of said flaw;

placing the remainder of said total amount of metal powder in said die to cover said copper foil;

compressing said powder with said press;

removing said compressed powder with said copper foil therein from said press and placing said compressed powder in a sintering furnace;

sintering said compressed powder in said sintering furnace at a temperature below the melting point of copper;

placing said sintered compressed powder in said press a second time and applying pressure thereto;

sintering said compressed powder a second time at a temperature above the melting point of said copper and below the melting point of said metal powder so as to form said metal powder into a metal body and so as to cause said copper foil to be melted and drawn into the porous metal surrounding said foil, thereby leaving a crack of the approximate size and shape of said metal foil.

12. A method according to claim 13 comprising applying pressure to said metal body after said second sintering.

* * * * *